US009617108B2

(12) United States Patent
Kamichi

(10) Patent No.: US 9,617,108 B2
(45) Date of Patent: Apr. 11, 2017

(54) RECORDING MEDIUM CONVEYOR AND IMAGE FORMING APPARATUS INCORPORATING THE RECORDING MEDIUM CONVEYOR

(71) Applicant: Junpei Kamichi, Tokyo (JP)

(72) Inventor: Junpei Kamichi, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/980,066

(22) Filed: Dec. 28, 2015

(65) Prior Publication Data

US 2016/0185558 A1 Jun. 30, 2016

(30) Foreign Application Priority Data

Dec. 26, 2014 (JP) ..... 2014-265995

(51) Int. Cl.
*B65H 29/12* (2006.01)
*B65H 5/06* (2006.01)
(Continued)

(52) U.S. Cl.
CPC ..... *B65H 29/125* (2013.01); *B65H 5/062* (2013.01); *B65H 29/14* (2013.01); *B65H 29/70* (2013.01); *B65H 2301/4212* (2013.01); *B65H 2301/5122* (2013.01); *B65H 2301/51214* (2013.01); *B65H 2301/51256* (2013.01); *B65H 2402/63* (2013.01); *B65H 2404/1115* (2013.01);
(Continued)

(58) Field of Classification Search
CPC ..... B65H 29/70; B65H 2301/5121; B65H 2301/5122; B65H 5/062; B65H 29/125
USPC ..... 271/188, 209
See application file for complete search history.

(56) References Cited

U.S. PATENT DOCUMENTS 4,933,726 A * 6/1990 Moriyama ..... B65H 29/70 399/405
5,094,660 A * 3/1992 Okuzawa ..... B65H 29/70 271/178
(Continued)

FOREIGN PATENT DOCUMENTS

JP 10-212062 8/1998
JP 2005-263334 9/2005
(Continued)

*Primary Examiner* — David H Bollinger
(74) *Attorney, Agent, or Firm* — Harness, Dickey & Pierce, P.L.C.

(57) ABSTRACT

A recording medium conveyor includable to an image forming apparatus includes a driving source, a first rotary unit, and a second rotary unit. The first rotary unit includes a driving gear, a driving shaft rotating with the driving gear, and multiple driving rotary bodies disposed on the driving shaft. The second rotary unit disposed facing the first rotary unit includes a driven gear meshed with the driving gear, a driven shaft, multiple driven rotary bodies disposed on the driven shaft, and multiple stiffening rotary bodies disposed between two of the multiple driven rotary bodies and having a diameter greater than an outer diameter of the multiple driven rotary bodies. A gear ratio between the driving gear and the driven gear is adjusted such that a peripheral speed of the multiple driving rotary bodies is equal to a peripheral speed of the multiple stiffening rotary bodies.

17 Claims, 9 Drawing Sheets

(51) Int. Cl.
*B65H 29/14* (2006.01)
*B65H 29/70* (2006.01)

(52) U.S. Cl.
CPC .. *B65H 2404/132* (2013.01); *B65H 2404/147* (2013.01); *B65H 2404/1415* (2013.01); *B65H 2515/81* (2013.01); *B65H 2801/06* (2013.01)

(56) References Cited

U.S. PATENT DOCUMENTS

| | | | | | |
|---|---|---|---|---|---|
| 5,153,663 | A * | 10/1992 | Bober | B65H 5/062 | 271/188 |
| 5,154,410 | A * | 10/1992 | Baader | B65H 29/70 | 271/188 |
| 5,927,709 | A * | 7/1999 | Greive | B65H 29/22 | 271/161 |
| 7,677,561 | B2 * | 3/2010 | Matsumoto | B65H 5/062 | 271/188 |
| 8,256,769 | B2 * | 9/2012 | Takahira | B65H 5/062 | 271/188 |
| 2002/0135124 | A1 * | 9/2002 | Suzuki | B65H 29/60 | 271/303 |
| 2006/0163803 | A1 * | 7/2006 | Izuchi | B65H 5/062 | 271/272 |

FOREIGN PATENT DOCUMENTS

| | | |
|---|---|---|
| JP | 2010-006538 | 1/2010 |
| JP | 2014-101218 | 6/2014 |

* cited by examiner

RECORDING MEDIUM CONVEYOR AND IMAGE FORMING APPARATUS INCORPORATING THE RECORDING MEDIUM CONVEYOR

CROSS-REFERENCE TO RELATED APPLICATIONS

This patent application is based on and claims priority pursuant to 35 U.S.C. §119(a) to Japanese Patent Application No. 2014-265995, filed on Dec. 26, 2014, in the Japan Patent Office, the entire disclosure of which is hereby incorporated by reference herein.

BACKGROUND

Technical Field

This disclosure relates to a recording medium conveyor and an image forming apparatus incorporating the recording medium conveyor.

Related Art

An image forming apparatus typically include a recording medium conveyor by which a recording medium is discharged to a sheet discharging device after an image is fixed to the recording medium by a fixing device. Such a sheet discharging device generally includes a driving roller and a driven roller.

Sheet discharging devices are expected to provide higher performance solution for preventing curling of a recording medium and for stacking the recording medium. In order to meet market demand, a known sheet discharging device includes a stiffening roller to stiffen a recording medium. The stiffening roller has an elastic body disposed on the same side as at least one driven roller. The stiffening roller can be disposed on the same side as at least one driving roller, as well. With these configurations, a recording medium is stiffened.

The above-described configuration, however, stiffens a recording medium with a stiffening roller having a large diameter. The large diameter stiffening roller extends and projects toward a nip region formed by a discharging roller. In such a case, the stiffening roller has a diameter greater than the sheet discharging roller. Therefore, regardless of whether the stiffening roller is disposed on the same side as the driving roller or the driven roller, a peripheral speed of the stiffening roller is greater than a peripheral speed of the sheet discharging roller.

With this configuration, the stiffening roller rubs the recording medium, defect such as gloss streaks is generated on an image formed on the recording medium. Consequently, removal of curl of a recording medium by stiffening the recording medium and higher stackability of the recording medium are not incompatible with prevention of image defect.

SUMMARY

At least one aspect of this disclosure provides a recording medium conveyor that includes a driving source, a first rotary unit, and a second rotary unit. The first rotary unit is rotated by the driving force, and includes a driving gear, a driving shaft, and multiple driving rotary bodies. The driving gear rotates by receiving the driving force. The driving shaft rotates together with the driving gear. The multiple driving rotary bodies are disposed spaced apart from each other on the driving shaft and integrally rotate with the driving shaft. The second rotary unit is disposed facing the first rotary unit and is rotated by the first rotary unit. The second rotary unit includes a driven gear, a driven shaft, multiple driven rotary bodies, and multiple stiffening rotary bodies. The driven gear is meshed with the driving gear. The driven shaft rotates together with the driven gear. The multiple driven rotary bodies are rotatably supported by the driven shaft, are disposed spaced apart from each other on the driven shaft, and pressed against the multiple driving rotary bodies. The multiple stiffening rotary bodies are disposed spaced apart from each other on the driven shaft, are disposed between adjacent two of the multiple driven rotary bodies, have a diameter greater than an outer diameter of each of the multiple driven rotary bodies, and integrally rotate with the driven shaft. A gear ratio between the driving gear of the first rotary unit and the driven gear of the second rotary unit is adjusted such that a peripheral speed of each of the multiple driving rotary bodies is equal to a peripheral speed of each of the multiple stiffening rotary bodies.

Further, at least one aspect of this disclosure provides an image forming apparatus including an image forming device to form an image on a recording medium, and the above-described recording medium conveyor to convey the recording medium.

DETAILED DESCRIPTION

Figure 1:
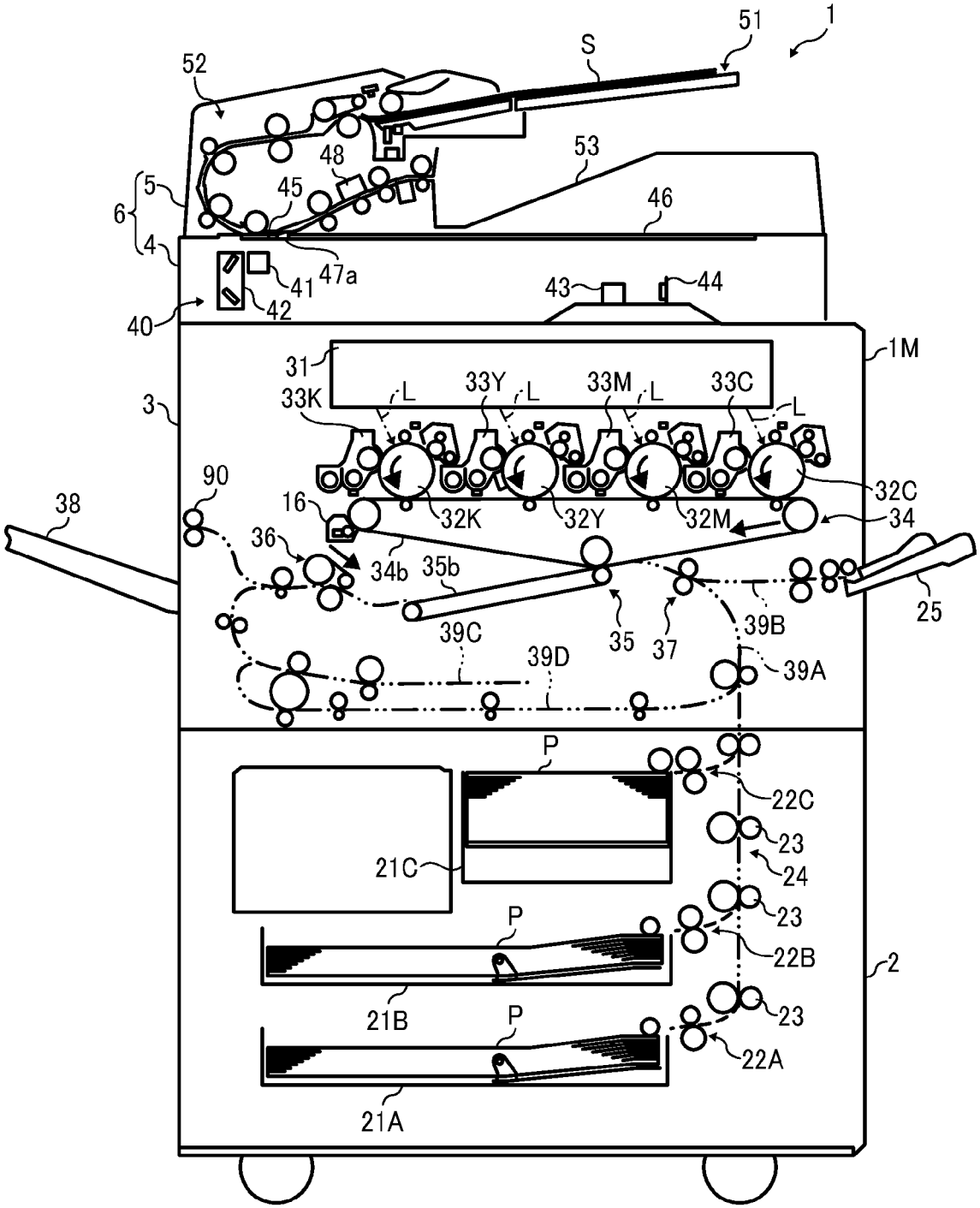
FIG. 1 is a cross sectional view illustrating an image forming apparatus according to an example of this disclosure, viewed from a front surface thereof.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of a basic configuration of an image forming apparatus 1 according to an example of this disclosure, with reference to FIG. 1.

FIG. 1 is a schematic diagram of the basic configuration of the image forming apparatus 1 according to the present example of this disclosure.

It is to be noted that identical parts are given identical reference numerals and redundant descriptions are summarized or omitted accordingly.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic MFP that forms color and monochrome toner images on recording media by electrophotography.

It is to be noted in the following examples that: the term "image forming apparatus" indicates an apparatus in which an image is formed on a recording medium such as paper, OHP (overhead projector) transparencies, OHP film sheet P, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

As illustrated in FIG. 1, the image forming apparatus 1 is a digital multifunction printer that includes an apparatus body 1M and an automatic document feeder (hereinafter, referred to as an ADF 5). The apparatus body 1M includes a sheet feeder 2, an image forming device 3, and an original document scanner 4.

The original document scanner 4 and the ADF 5 form an image reading device 6.

The image forming device 3 includes a recording medium conveyor according to an example of this disclosure, which is a sheet discharging device 90 in this disclosure.

The sheet feeder 2 includes multiple sheet trays 21A, 21B, and 21C. Each of the multiple sheet trays 21A, 21B, and 21C accommodates recording mediums P as a bundle of recording media P loaded therein in layers, including a recording medium P. The multiple sheet trays 21A, 21B, and 21C include the recording media P (for example, white papers) therein either in a portrait orientation or in a landscape orientation. The size of accommodation space in each of the multiple sheet trays 21A, 21B, and 21C to contain the recording media P to be used can be selected from multiple sheet sizes previously prepared in the image forming apparatus 1.

The sheet feeder 2 includes respective sheet feeding member 22A, 22B, and 22C, multiple rollers 23, and a sheet feeding path 24.

An uppermost recording medium P placed on top of the bundle of recording media P is picked up from a selected one of the sheet feeding member 22A, 22B, and 22C pick up each uppermost recording medium P of the recording media P stored in the multiple sheet trays 21A, 21B, and 21C, respectively, one by one to separate from the other recording media P and feed the picked recording medium P to the sheet feeding path 24.

The multiple rollers 23 convey the recording medium P picked up from the selected one of the multiple sheet trays 21A, 21B, and 21C to a given image forming position of the image forming device 3 via the sheet feeding path 24 is defined by the multiple rollers 23.

The image forming device 3 includes an exposure device 31, photoconductor drums 32K, 32Y, 32M, and 32C, and developing devices 33K, 33Y, 33M, and 33C. The developing devices 33K, 33Y, 33M, and 33C include black (K), yellow (Y), magenta (M), and cyan (C) color toners filled therein, respectively. The image forming device 3 further includes a primary transfer unit 34, a secondary transfer unit 35, and a fixing unit 36.

The exposure device 31 generates a laser light beam L corresponding to each color of the black (K), yellow (Y), magenta (M), and cyan (C) color toners based on the image read by the image reading device 6. The exposure device 31 emits the laser light beam L to irradiate the photoconductor drums 32K, 32Y, 32M, and 32C. By so doing, respective electrostatic latent images corresponding to the black (K), yellow (Y), magenta (M), and cyan (C) color toners are formed on respective surfaces of the photoconductor drums 32K, 32Y, 32M, and 32C corresponding to the images read by the image reading device 6.

The developing devices 33K, 33Y, 33M, and 33C supply respective color toners to the corresponding photoconductor drums 32K, 32Y, 32M, and 32C to form a thin layer from a close position. By so doing, the electrostatic latent image is developed into visible toner images.

The image forming device 3 primarily transfers the visible toner images formed on the respective surfaces of the photoconductor drums 32K, 32Y, 32M, and 32C sequentially into a composite four color toner image onto the primary transfer unit 34 in respective primary transfer nip regions. Thereafter, the secondary transfer unit 35 of the image forming device 3 disposed adjacent to the primary transfer unit 34 secondarily transfers the composite four color toner image onto the recording medium P in a secondary transfer nip region.

The image forming device 3 conveys the toner image formed on the recording medium P is fused in the fixing unit 36 by application of heat and pressure, so that the composite color image is fixed to the recording medium P.

The image forming device 3 further includes a conveying path 39A, a bypass tray 25, a bypass tray sheet feeding path 39B, a switchback sheet conveying path 39C, and a sheet reversing path 39D.

The image forming device 3 further includes a sheet conveying path 39A, through which the recording medium P that has been conveyed from the sheet feeder 2 via the sheet feeding path 24 is further conveyed toward the secondary transfer unit 35. In the sheet conveying path 39A, the pair of registration rollers 37 adjusts the conveying timing and speed of the recording medium P. In synchronization with the belt speeds at the primary transfer unit 34 and the secondary transfer unit 35, the recording medium P passes the secondary transfer unit 35 and the fixing unit 36, and further passes the sheet discharging device 90, so that the recording medium P is discharged to the sheet discharging device 90 onto a sheet discharging tray 38.

Details of the sheet discharging device 90 are described below.

The bypass tray sheet feeding path 39B feeds the recording medium P placed on the bypass tray 25 to the sheet conveying path 39A at a position upstream from the pair of registration rollers 37 in a sheet conveying direction.

The switchback sheet conveying path 39C and the sheet reversing path 39D are located below the secondary transfer unit 35 and the fixing unit 36. The switchback sheet conveying path 39C and the sheet reversing path 39D are defined by multiple sheet conveying rollers and multiple sheet conveying guides.

In duplex printing in which images are formed on both surfaces of the recording medium P, after the recording medium P having an fixed image on one surface thereof has entered from one end of the switchback conveying path 39C, the switchback conveying path 39C performs switchback conveyance to retreat, in other words, move in an opposite direction to the direction the recording medium P is conveyed at the entry.

After the recording medium P has been switched back by the switchback conveying path 39C, the sheet reversing path 39D reverses the recording medium P upside down and feeds the reversed recording medium P to the pair of registration rollers 37.

After completion of an image fixing operation to a front surface (a first surface) of the recording medium P, the sheet conveying direction of the recording medium P is switched in the switchback conveying path 39C and the front surface and a back surface (a second surface) of the recording medium P is turned upside down. Thereafter, the recording medium P is conveyed to the secondary transfer nip region again. After the secondary transfer operation of the image and the image fixing operation to the back surface of the recording medium P are finished, the recording medium P is discharged to the sheet discharging tray 38.

The original document scanner 4 includes a first surface scanning device 40, a first carriage 41, a second carriage 42, an image forming lens 43, an image forming unit 44, and a first exposure glass 45.

The first surface scanning device 40 scans and reads an image on one side of an original document sheet S, for example, the image on the front surface of the original document sheet S, which is conveyed to the first exposure glass 45. The "first surface" of the first surface scanning device 40 represents one side of the original document sheet S that is automatically fed, for example, the front surface of the original document sheet S.

The first carriage 41 includes a light source and at least one mirror.

The second carriage 42 includes at least one mirror.

The first carriage 41, the second carriage 42, the image forming lens 43, the image forming unit 44, and the first exposure glass 45 are disposed on the side of the apparatus body 1M.

The original document scanner 4 further includes a second exposure glass 46 and a contact member 47*a*.

The second exposure glass 46 holds the original document sheet S thereon.

The contact member 47*a* contacts one edge side of the original document sheet S and positions the original document sheet S.

The first carriage 41 is movably disposed below the first exposure glass 45 and the second exposure glass 46 and can be moved from left to right on FIG. 1 and can adjust the position of the image. The first carriage 41 can receive light emitted from the light source and reflect by the at least one mirror so as to irradiate on the side of an exposed side of the original document sheet S. The light reflected on the original document sheet S is further reflected on the at least one mirror mirrors of the first carriage 41 and the at least one mirror of the second carriage 42, and eventually the image forming lens 43 forms an image. Then, the formed image is scanned by the image forming unit 44.

The original document scanner 4 causes the first carriage 41 and the second carriage 42 to move at a speed ratio of 2:1, for example, with the light source turned on. At the same time, the image formed side of the original document sheet S placed on the second exposure glass 46 and the image data of the original document can be optically scanned.

Then, the image forming unit 44 of the original document scanner 4 reads the image on the original document sheet S when exposing and scanning the recording medium P. By so doing, a fixed original document reading function (a flat bed scanner function) is performed.

The original document scanner 4 can cause the first carriage 41 to stop at a given position immediately below the first exposure glass 45. Then, a moving document scanning function (a document feeding scanning or DF scanning function) can be performed without moving various optical units such as the light source and the reflection mirrors. The moving document scanning function is also referred to as a document feeding scanning or DF scaning function by which the first surface of the original document sheet S is scanned during automatic document conveyance of the original document sheet S.

In addition to the first surface scanning device 40 included in the original document scanner 4, the image forming apparatus 1 also includes a second surface scanning device 48 that is embedded on the side of the ADF 5.

The second surface scanning device 48 scans an image formed on the second surface, for example, the back surface of the recording medium P, for example, after the recording medium P has passed on the first exposure glass 45.

The ADF 5 is openably closable attached on top of the apparatus body 1M of the image forming apparatus 1 via hinges 1*h*. The ADF 5 is connected to the apparatus body 1M. The ADF 5 can be rotated or turned between an open position at which the first exposure glass and the second exposure glass 46 of the original document scanner 4 are exposed and a closed position at which the first exposure glass 45 and the second exposure glass 46 are covered and hidden.

The ADF 5 is an automatic document feeder of sheet through system. The ADF 5 includes an original document table 51, a document conveying unit 52, and an original document discharging tray 53.

The original document table 51 functions as an original document loader.

The document conveying unit 52 includes various rollers and guide members.

The original document discharging tray 53 stacks the original document sheet(s) thereon after each image formed on the original document sheet(s) thereon has been read.

Figure 2:
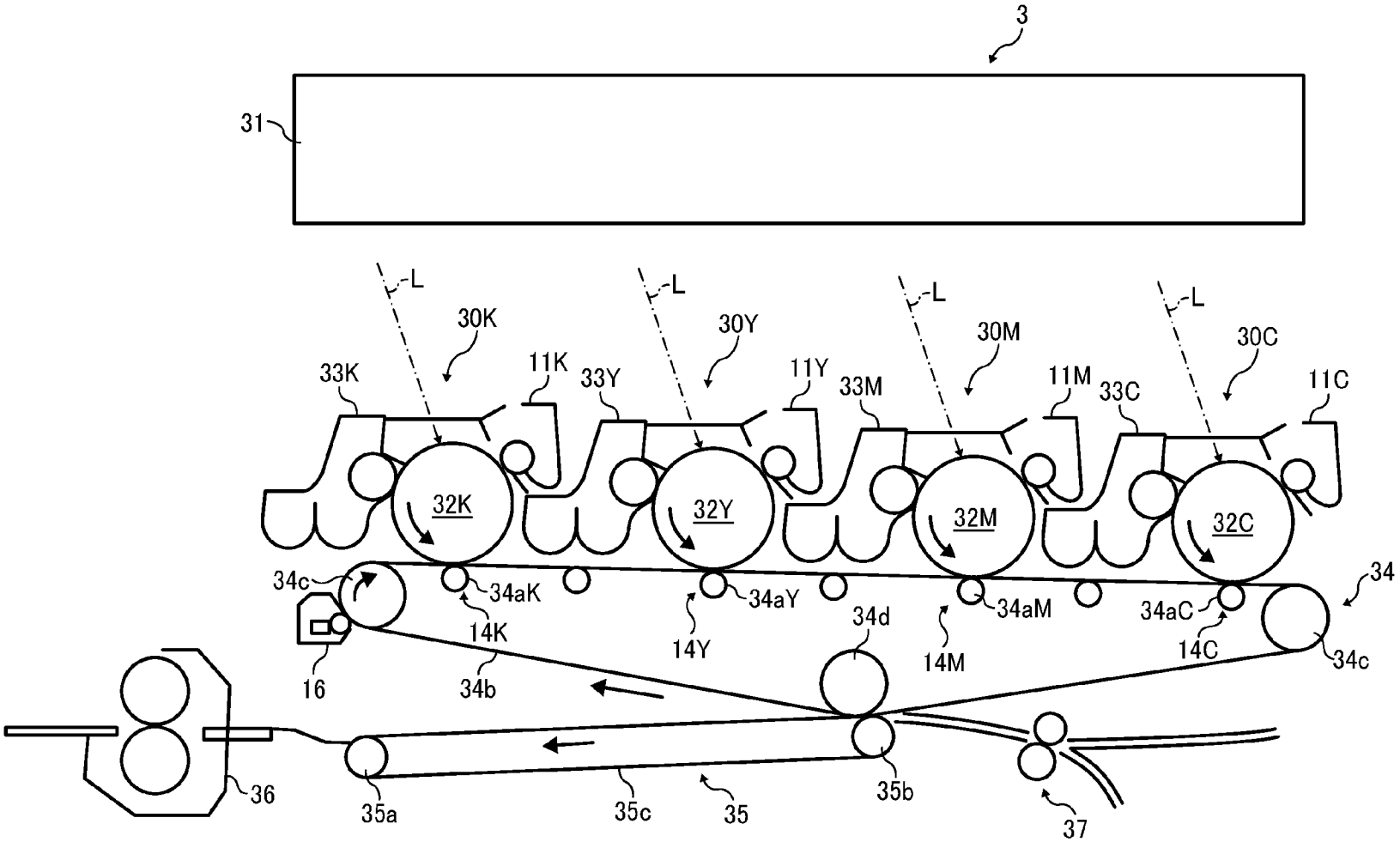
FIG. 2 is a diagram illustrating a schematic configuration of an image forming device included in the image forming apparatus of FIG. 1.

As illustrated in FIG. 2, the image forming device 3 includes an exposure device 31, photoconductor drums 32K, 32Y, 32M, and 32C, and developing devices 33K, 33Y, 33M, and 33C. The developing devices 33K, 33Y, 33M, and 33C are filled with black (K), yellow (Y), magenta (M), and cyan (C) color toners, respectively.

The image forming device 3 further includes a primary transfer unit 3, a secondary transfer unit 35, and a fixing unit 36.

It is to be noted that, the units and components included in the image forming device 3 of the image forming apparatus 1 are hereinafter referred to in a singular unit occasionally without suffix indicating toner colors. For example, the photoconductor drums 32K, 32Y, 32M, and 32C may also be referred to as "the photoconductor drum 32".

The photoconductor drum 32 (i.e., the photoconductor drums 32K, 32Y, 32M, and 32C) and the developing device 33 (i.e., the developing devices 33K, 33Y, 33M, and 33C) form a drum cleaning device 11 (i.e., drum cleaning devices 11K, 11Y, 11M, and 11C) and a process unit 30 (i.e., process units 30K, 30Y, 30M, and 30C). The process units 30K, 30Y, 30M, and 30C have basically identical configurations, except for the colors of toners used in here.

The exposure device 31 generates the laser light beam L of each color based on the image scanned by the image reading device 6, for example. The exposure device 31 irradiates the photoconductor drum 32 (i.e., the photoconductor drums 32K, 32Y, 32M, and 32C) to form an electrophotographic latent image corresponding to the image data read by the original document scanner 4 of the image reading device 6 on a surface of the photoconductor drum 32.

The developing device 33 (i.e., the developing devices 33K, 33Y, 33M, and 33C) supplies toner in a thin layer on the photoconductor drums 32 to develop the electrophotographic latent image into a visible toner image.

The image forming device 3 transfers the respective visible toner images formed on the respective surfaces of the photoconductor drums 32K, 32Y, 32M, and 32C sequentially onto the primary transfer unit 34 to form a composite four color toner image, and further transfers the composite four color toner image onto the surface of the recording medium P in the secondary transfer unit 35 that is disposed adjacent to the primary transfer unit 34.

The image forming device 3 further conveys the recording medium P to the fixing unit 36 to fuse the composite four color toner image formed on the recording medium P by application of heat and pressure and fix to the surface of the recording medium P.

As illustrated in FIG. 2, the primary transfer unit 34 includes transfer units 14K, 14Y, 14M, and 14C disposed below the photoconductor drums 32K, 32Y, 32M, and 32C of the process units 30K, 30Y, 30M, and 30C, respectively.

The primary transfer units 34 further includes primary transfer rollers 34*a*K, 34*a*Y, 34*a*M, and 34*a*C, an intermediate transfer belt 34*b*, and sheet conveying rollers 34*c* and 34*d*.

Each of the primary transfer rollers 34*a*K, 34*a*Y, 34*a*M, and 34*a*C is provided to the corresponding transfer unit 14. The primary transfer rollers 34*a*K, 34*a*Y, 34*a*M, and 34*a*C are disposed in contact with the intermediate transfer belt 34*b*.

The intermediate transfer belt 34*b* is an endless belt wound around and stretched by the primary transfer rollers 34*a*K, 34*a*Y, 34*a*M, and 34*a*C and the sheet conveying rollers 34*c* and 34*d*.

The transfer units 14K, 14Y, 14M, and 14C are disposed facing the photoconductor drums 32K, 32Y, 32M, and 32C, respectively, with the intermediate transfer belt 34*b* interposed therebetween, so that the intermediate transfer belt 34*b* rotates in a clockwise direction of FIG. 2. With this configuration, the respective primary transfer nip regions are formed between each of the photoconductor drums 32K, 32Y, 32M, and 32C and the intermediate transfer belt 34*b*.

In the vicinity of the primary transfer nip regions, the respective primary transfer rollers 34*a*K, 34*a*Y, 34*a*M, and 34*a*C are disposed in contact with an inner loop of the intermediate transfer belt 34*b* and press the intermediate transfer belt 34*b* toward the corresponding photoconductor drums 32K, 32Y, 32M, and 32C. A power supply applies a primary transfer bias to each of the primary transfer rollers 34*a*K, 34*a*Y, 34*a*M, and 34*a*C. With application of the primary transfer bias, a primary transfer electric field is generated in each of the primary transfer nip regions so as to electrostatically move (transfer) the toner image formed on each of the respective surfaces of the photoconductor drums 32K, 32Y, 32M, and 32C onto the surface of the intermediate transfer belt 34*b*.

As the intermediate transfer belt 34*b* rotates in the clockwise direction of FIG. 2, an outer circumferential surface of the intermediate transfer belt 34*b* sequentially passes the primary transfer nip regions, so that the respective single color toner images are overlaid at the respective primary transfer nip regions to form the composite four color toner image. This image transfer operation is referred to as a primary transfer operation. Due to the primary transfer operation, the composite four color toner image is formed on the outer circumferential surface of the intermediate transfer belt 34*b*.

As illustrated in FIG. 2, the secondary transfer unit 35 includes a drive roller 35*a*, a secondary transfer roller 35*b*, and a sheet conveying belt 35*c*.

The secondary transfer roller 35*b* is disposed adjacent to and facing the sheet conveying roller 34*d* of the primary transfer unit 34.

The sheet conveying belt 35*c* is an endless belt that is wound around and stretched by the drive roller 35*a* and the secondary transfer roller 35*b*. The sheet conveying belt 35*c* rotates along with rotation of the drive roller 35*a*.

Both the intermediate transfer belt 34*b* of the primary transfer unit 34 and the sheet conveying belt 35*c* of the secondary transfer unit 35 are interposed between the sheet conveying roller 34*d* and the secondary transfer roller 35*b*. With this configuration, the outer circumferential surface of the intermediate transfer belt 34*b* and the outer circumferential surface of the sheet conveying belt 35*c* contact to form the secondary transfer nip region.

The power supply applies a secondary transfer bias to the secondary transfer roller 35*b*. Further, the sheet conveying roller 34*d* disposed at a lower part of the primary transfer unit 34 is grounded. With application of the primary transfer bias, a secondary transfer electric field is generated in the secondary transfer nip region.

The pair of registration rollers 37 adjusts the recording medium P to be conveyed at the same speed as rotation of the intermediate transfer belt 34*b* and to receive the composite four color toner image at the synchronized timing with movement of the composite four color toner image on the outer circumferential surface of the intermediate transfer belt 34*b*.

In the secondary transfer nip region, the composite four color toner image formed on the intermediate transfer belt 34*b* is transferred onto the recording medium P with the effect of the secondary electric field and the nip pressure. Consequently, the composite four color toner image is combined with white color of the recording medium P to be a full color image.

After passing the secondary transfer nip region, the recording medium P is separated from the intermediate transfer belt 34*b*. Then, as the sheet conveying belt 35*c* rotates, the recording medium P is conveyed to the fixing unit 36 while being held by the outer circumferential surface of the sheet conveying belt 35*c*.

Even after the composite four color toner image is transferred onto the recording medium P in the secondary transfer nip region, the intermediate transfer belt 34*b* has residual toner remaining on the outer circumferential surface thereof. The residual toner is the toner failed to be transferred onto the recording medium P in the secondary transfer nip region and is scraped and removed from the outer circumferential surface of the intermediate transfer belt 34*b* by a belt cleaning device 16. The belt cleaning device 16 is disposed in contact with the intermediate transfer belt 34*b*.

In the fixing unit 36, the full color image is fixed to the recording medium P by application of heat and pressure. After being discharged from the fixing unit 36, the recording medium P is conveyed to a pair of sheet discharging rollers and further to the sheet discharging tray 38 that is disposed outside the apparatus body 1M.

Figure 3:
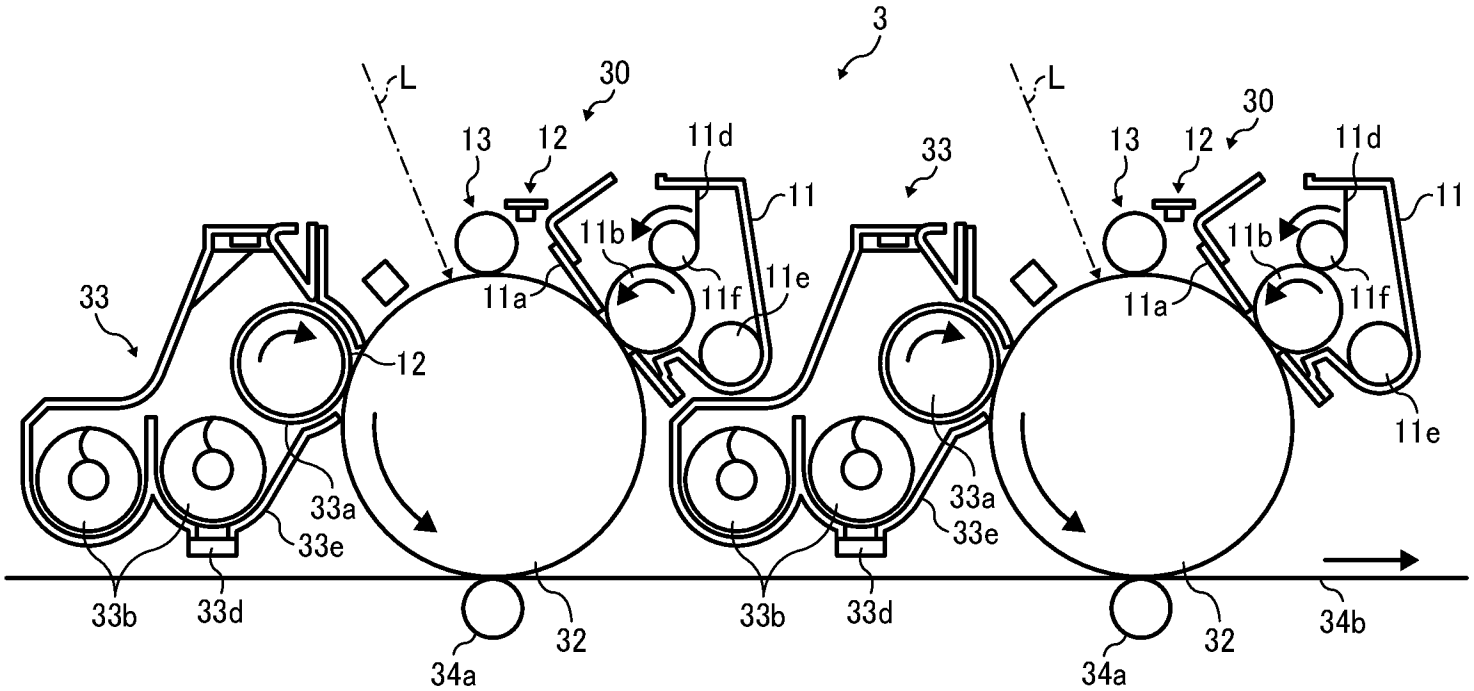
FIG. 3 is a diagram illustrating a process unit of the image forming device of the image forming apparatus of FIG. 1.

FIG. 3 is a diagram illustrating process units 30 of the image forming device 3 of the image forming apparatus 1.

It is to be noted that the process units 30K, 30Y, 30M, and 30C in the image forming device 3 employ different single color toners, which are black (K), yellow (Y), magenta (M), and cyan (C) color toners. Except for the colors of toners, the process units 30K, 30Y, 30M, and 30C have configurations identical to each other. Accordingly, FIG. 3 does not show any suffix indicating the difference of the toner colors. It is also to be noted that, hereinafter, the process units 30K, 30Y, 30M, and 30C are occasionally referred to in a singular form, such as the process unit 30.

As illustrated in FIG. 3, the process unit 30 includes the photoconductor drum 32, the developing device 33, a drum cleaning device 11, an electric discharging lamp 12, and a charging roller 13.

The drum cleaning device 11, the electrical discharging lamp 12, and the charging roller 13 are disposed around the photoconductor drum 32.

In the process unit 30, the photoconductor drum 32 has a drum-shaped body with a photoconductive layer coated with organic photoconductor material over an aluminum elementary tube or the like.

The laser light beam L generated by the exposure device 31 is emitted to irradiate the surface of the photoconductor drum 32, so as to form, on the photoconductor drum 32, an electrostatic latent image corresponding to the image data read by the original document scanner 4 of the image reading device 6.

The developing device 33 includes a developing sleeve 33*a*, two transfer screws 33*b*, a toner density sensor 33*d*, and a developer case 33*e*. The developing device 33 accommodates two-component developer including magnetic carriers and non-magnetic toner in the developer case 33*e*. The two transfer screws 33*b* stir and supply the two-component developer to the developing sleeve 33*a*.

The developing device 33 includes one or more magnets disposed in a hollow space inside the developing sleeve 33*a*, so as to bear part of non-magnetic toner contained in the two-component developer in a thin layer. By so doing, the thin-layered toner on the developing sleeve 33*a* can be transported onto the electrophotographic latent image formed on the photoconductor drum 32.

After transport of the toner to the electrostatic latent image formed on the photoconductor drum 32, the developing sleeve 33*a* has residual toner remaining on the outer circumferential surface thereof. The residual toner here is the toner failed to be transferred onto the photoconductor drum 32 and is returned to the developer case 33*e* along with rotation of the developing sleeve 33*a*. When being returned to the developer case 33*e*, the residual toner is separated from the developing sleeve 33*a* due to the action of a repulsive magnetic field generated by the magnet(s) disposed inside the developing sleeve 33*a*.

Further, the toner density sensor 33*d* disposed in the developer case 33*e* detects the concentration of the non-magnetic toner in the developer case 33*e*. With this configuration, an appropriate amount of toner is supplied to the two-component developer based on the results detected by the toner density sensor 33*d*.

The drum cleaning device 11 (i.e., the drum cleaning devices 11K, 11Y, 11M, and 11C) includes a cleaning blade 11*a*, a fur brush 11*b*, an electric field roller 11*f*, a scraper 11*d*, and a collection screw 11*e*.

The cleaning blade 11*a* is an elastic member of polyurethane rubber to be pressed against the outer circumferential surface of the photoconductor drum 32.

The fur brush 11*b* is a conductive member to contact the outer circumferential surface of the photoconductor drum 32.

The electric field roller 11*f* is a metallic member that contacts and applies a bias to the fur brush 11*b*. The electric field roller 11*f* is rotatably disposed in a counter direction, which is a direction indicated by arrow in FIG. 3.

The scraper 11*d* has a leading edge that is pressed against the electric field roller 11*f*.

The collection screw 11*e* is disposed below the scraper 11*d*.

The residual toner remaining on the outer circumferential surface of the photoconductor drum 32 adheres to the fur brush 11*b*. After transported from the fur brush 11*b* to the electric field roller 11*f*, the residual toner is scraped and removed by the scraper 11*d*. Thereafter, the collection screw 11*e* conveys the scraped residual toner from the drum cleaning device 11 to an outside recycle recording medium conveyor.

The electric discharging lamp 12 removes residual electric charge remaining on the surface of the photoconductor drum 32 by photo irradiation. Thereafter, the charging roller 13 uniformly charges the electrically discharged surface of the photoconductor drum 32 again. Then, the exposure device 31 optically irradiates the uniformly charged surface of the photoconductor drum 32 by emitting the laser light beam L, so that an electrostatic latent image is formed on the surface of the photoconductor drum 32.

The primary transfer rollers 34*a*K, 34*a*Y, 34*a*M, and 34*a*C are disposed below the photoconductor drums 32K, 32Y, 32M, and 32C, respectively, and are aligned in contact with the inner loop of the intermediate transfer belt 34*b*, so that the intermediate transfer belt 34*b* rotates while contacting the photoconductor drums 32K, 32Y, 32M, and 32C.

Figure 4:
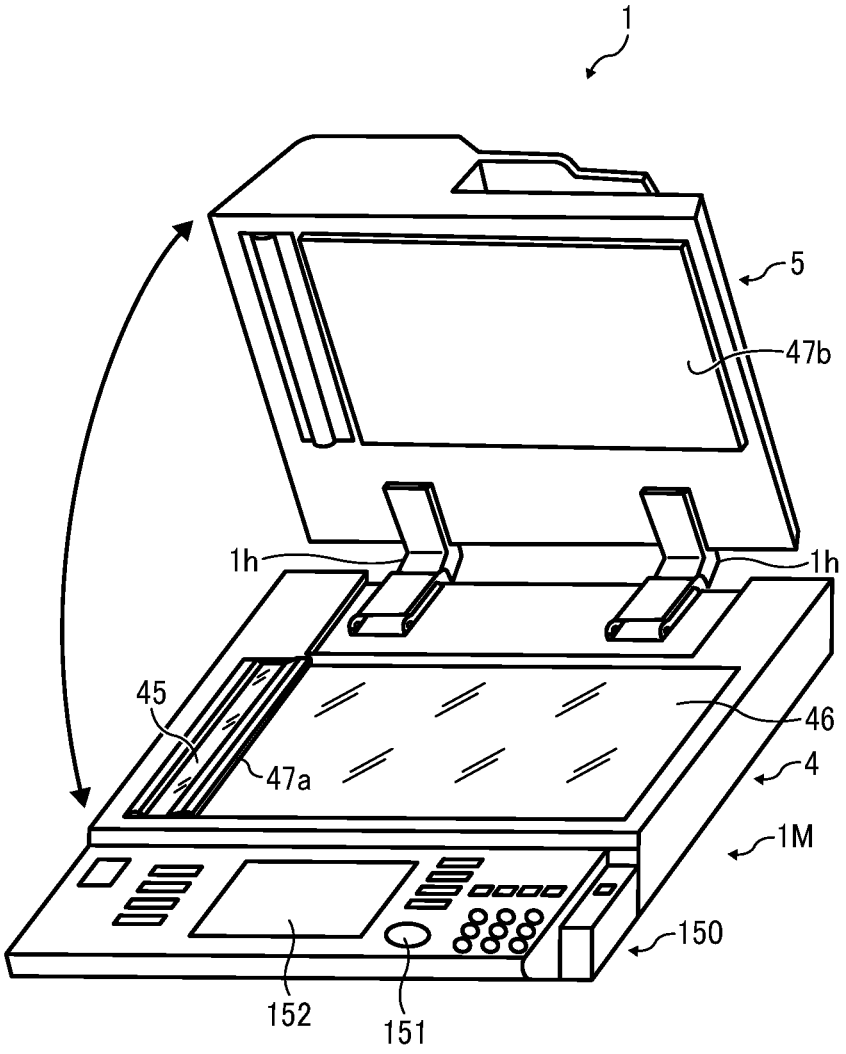
FIG. 4 is a perspective view illustrating of a joint part of the image forming apparatus of FIG. 1, which joins an apparatus body and an original document conveying device.

As illustrated in FIG. 4, the original document scanner 4 is mounted on the apparatus body 1M of the image forming apparatus 1.

The original document scanner 4 includes the first exposure glass 45 that is positioned in a document conveying path 56 through which the original document sheet S travels, the second exposure glass 46 on which the original document sheet S can be placed, and the contact member 47*a* to which one edge side of the original document sheet S contacts to position the original document sheet S.

Further, the apparatus body 1M includes an instruction input unit 150 on an upper front side of the image forming apparatus 1.

The instruction input unit 150 includes a print key 151 and a touch panel 152. As the print key 151 is pressed down, a copy start signal is issued to the image forming apparatus 1.

The ADF 5 is mounted on the apparatus body 1M of the image forming apparatus 1 via the hinges 1*h*. As illustrated in FIG. 4, the hinges 1*h* are provided as a joint part to connect the ADF 5 to the apparatus body 1M via the hinges 1H, so that the ADF 5 can open and close with respect to the apparatus body 1M. An original document cover 47*b* is attached to a lower surface of the ADF 5. As previously described, the ADF 5 can be rotated or turned between the open position at which the first exposure glass 45 and the second exposure glass 46 of the original document scanner 4 are exposed and a closed position at which the first exposure glass 45 and the second exposure glass 46 are covered.

Figure 5:
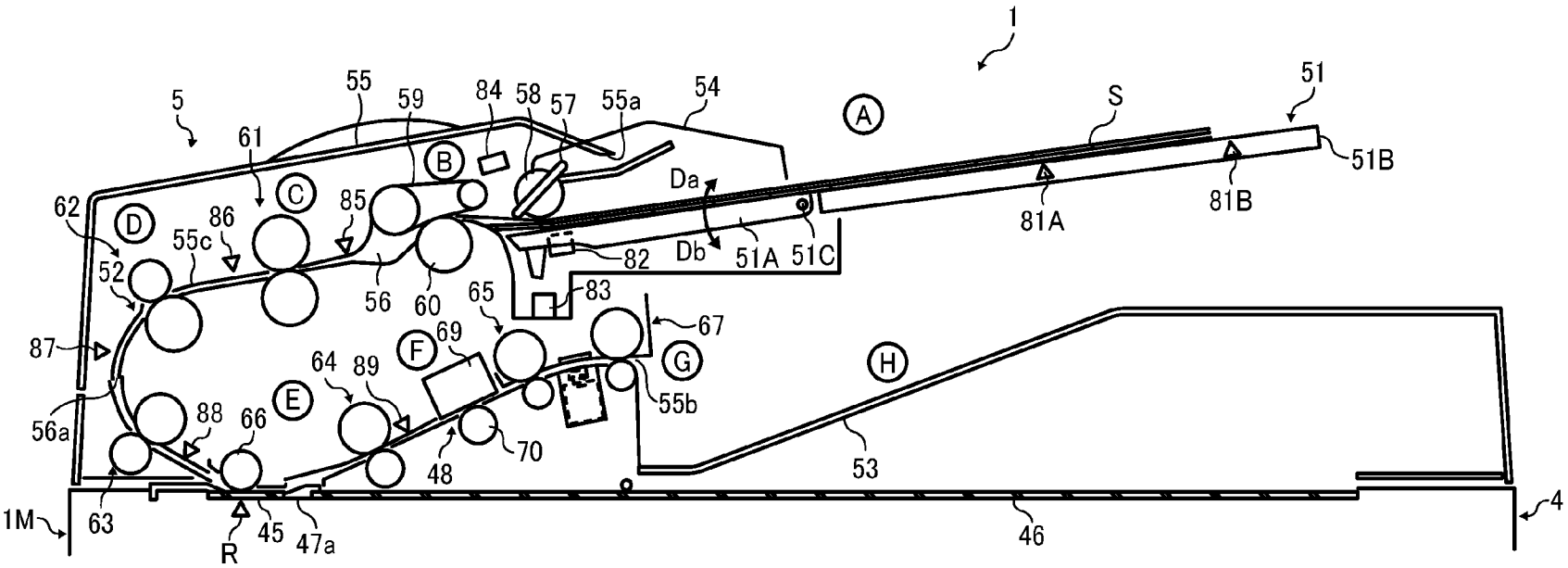
FIG. 5 is a diagram illustrating a schematic configuration of an original document conveying device of the image forming apparatus of FIG. 1.

As illustrated in FIG. 5, the ADF 5 is an automatic document feeder of sheet through system. The ADF 5 includes the original document table 51 that functions as an original document loader, the document conveying unit 52 that includes various rollers and guide members, and the original document discharging tray 53 that stacks the original document sheet(s) thereon after each image formed on the original document sheet(s) thereon has been read.

Further, as illustrated in FIG. 5, the ADF 51 has various portions to process a series of document feeding operations, which are a document setting part A, a separated document feeding part B, a registration part C, a turning part D, a first fixed scanning part E, a second fixed scanning part F, a document discharging part G, and a document stacking part H. These parts are controlled by an ADF controller 100.

The document setting part A is a sheet loading table that can load at least one cut-sheet-type original document sheet S, for example, a bundle of multiple original document sheets S thereon. For performing a single-sided printing, the original document sheet S is loaded on the document setting part A with the front surface of the original document sheet S facing upward.

The separated document feeding part B separates an uppermost original document sheet S from the bundle of the multiple original document sheet S on the document setting part A and feeds the uppermost original document sheet S toward an opening of the document conveying path 56.

The registration part C aligns the original document sheets S sequentially fed from the separated document feeding part B by causing the original document sheets S to temporarily abut against a sheet feeding belt 59 and a reverse roller 60 so that the posture of the original document sheet S is adjusted. Further, the registration part C conveys the aligned original document sheet S to a downstream side from the sheet feeding belt 59 and the reverse roller 60 in a document feeding direction.

The turning part D further turns the original document sheet S that has been conveyed from the registration part C such that the original document sheet S is reversed upside down to place the front surface thereof facing downward.

In the first scanning and conveying part E, the original document sheet S reversed in the turning part D passes a reading position on the first exposure glass 45. At the same time, the first scanning and conveying part E causes the original document sheet S to travel in a sub-scanning direction, which is a direction perpendicular to a main scanning direction or a document width direction, at a given speed.

The second scanning and conveying part F is disposed downstream from the first scanning and conveying part E in the document feeding direction, and therefore a main scanning position thereof at which an image formed on the front surface of the original document sheet S is read is located downstream from a main scanning position at which an image formed on a back surface of the original document sheet S is read.

In duplex printing, the second scanning and conveying part F reads the image formed on the back surface of the original document sheet S along the main scanning direction at the main scanning position thereof through a different exposure glass from a diagonally upward left side in FIG. 5, so that the original document sheet S is conveyed in the sub-scanning direction at a given speed.

After completion of reading the image on the front surface or both the front and back surfaces of the original document sheet S in the first scanning and conveying part E and the second scanning and conveying part F, the document discharging part G causes the original document sheet S to be discharged to the document stacking part H.

The document stacking part H receives and stacks the original document sheets S sequentially discharged from the document discharging part G with the front surface of the original document sheets S facing downward. The original document sheets S stacked on the document stacking part H are aligned in the same order as loaded on the document setting part A. Specifically, the whole bundle thereof are stacked in layers with the front and back surfaces of the original document sheets S placed upside down.

The document setting part A, the separated document feeding part B, the registration part C, the turning part D, the first scanning and conveying part E, the second scanning and conveying part F, the document discharging part G, and the document stacking part H are controlled by the ADF controller 100 that controls operations performed by the ADF 5.

The ADF 5 separates the uppermost original document sheet S one by one from the bundle of original document sheets S loaded on the original document table 51. Then, the document conveying unit 52 conveys the uppermost original document sheet S via a given conveying path that passes on or over the first exposure glass 45. Further, after the original document scanner 4 has read the image formed on the original document sheet S when passing the first exposure glass 45, the ADF 5 discharges the original document sheet S to the original document discharging tray 53.

The original document sheet S is placed on the original document table 51 with the front surface thereof facing upward and slanted downwardly in the document feeding direction. Specifically, the original document table 51 loads the original document sheet S with the leading edge thereof directing to a downstream side of the original document table 51, which is a side close to the document conveying unit 52, and with the trailing edge thereof directing to an upstream side, which is a side close to a free end of the original document table 51. By so doing, the position of the leading edge of the original document sheet S is located higher than the position of the trailing edge of the original document sheet S.

The original document table 51 is divided into a movable original document table 51A and a trailing edge side original document table 51B.

The movable original document table 51A rotates about a shaft 51C with the leading edge of the original document sheet S tilting downwardly according to a thickness of the bundle of original document sheets S. By driving a bottom plate lift motor 105, the movable original document table 51A rotates in substantially vertical directions indicated by arrows "Da" and "Db" as illustrated in FIG. 5.

The movable original document table 51A includes a pair of side guide plates 54. The pair of side guide plates 54 positions and aligns a left-and-right direction of the original document sheet S in the document feeding direction. The left-and-right direction corresponds to a lateral direction or a width direction of the original document S and is perpendicular to the document feeding direction of the original document sheet S toward the document conveying unit 52. The pair of side guide plates 54 is a pair of guide plates disposed relatively separatable and closable to each other in the width direction of the movable document table 51A so as to match the movable original document table 51A and a reference position in the width direction of the original document sheet S.

A cover 55 covers at least an upward side of the document conveying unit 52. The cover 55 includes a document inlet slot 55*a* to guide the leading edge of the original document sheet S into an inside of the cover 55. The cover 55 also covers an upward side of a downstream side of the movable original document table 51A so that the downstream side of the movable original document table 51A is positioned inside or downstream from the document inlet slot 55*a* in the document conveying direction.

The document conveying unit 52 defines the document conveying path 56 extending from the document inlet slot 55*a* to a document outlet slot 55*b* that is disposed above the original document discharging tray 53. The document conveying path 56 is covered by a rib 55*c* and other guide members provided to the cover 55.

The document conveying unit 52 includes a set feeler 57 disposed above the downstream side of the movable original document table 51A, which is an upstream end of the document conveying unit 52 on the document inlet slot 55*a* side in the document feeding direction of the original document sheet S. The set feeler 57 is rotated with movement of the original document sheet S loaded on the movable original document table 51A.

The document conveying unit 52 further includes a pickup roller 58, the sheet feeding belt 59, and the reverse roller 60.

The pickup roller 58 is disposed near and downstream from the document inlet slot 55*a* in the document feeding direction.

The sheet feeding belt 59 is an endless belt in a loop form.

The sheet feeding belt 59 and the reverse roller 60 (a sheet feeding body) are disposed facing each other with the document conveying path 56 therebetween.

At the contact position, the pickup roller 58 is driven by a pickup motor 101. The pickup roller 58 frictionally picks up some of uppermost original document sheets S (desirably, a single uppermost original document sheet S) from the bundle of original document sheets S placed on the original document table 51.

The sheet feeding belt 59 is rotated by a sheet feed motor 102, so that one side of the sheet feeding belt 59 moves in the document feeding direction.

The reverse roller 60 is rotatable in a reverse direction that is a direction opposite to the document feeding direction of the sheet feeding belt 59 and includes a torque limiter. The reverse roller 60 contacts the sheet feeding belt 59 with a given pressure. When contacting the sheet feeding belt 59 directly or with a single original document sheet S held therebetween, the reverse roller 60 is rotated with rotation of the sheet feeding belt 59 in a counterclockwise direction.

When the multiple original document sheets S enter between the sheet feeding belt 59 and the reverse roller 60, the reverse roller 60 exerts a force to rotate with the sheet feeding belt 59 in the counterclockwise direction that is lower than a force corresponding to the set torque of the torque limiter. Therefore, the reverse roller 60 pushes an extra original document sheet S or extra original document sheets S back to the upstream side from the contact part where the sheet feeding belt 59 and the reverse roller 60 contact together. By so doing, the reverse roller 60 can prevent the original document sheet S from multifeeding.

The document conveying unit 52 includes multiple pairs of sheet conveying rollers 61 through 65. Each of the multiple pairs of sheet conveying rollers 61 through 65 has two rollers disposed facing each other with the document conveying path 56 defined therebetween and with the original document sheet S nipped therebetween while travelling in the document conveying path 56. Further, the two rollers of each of the multiple pairs of sheet conveying rollers 61 through 65 have the same diameter or different diameters. For example, the two rollers of each of the multiple pairs of sheet conveying rollers 61 through 65 are disposed in contact with each other in a diameter direction. However, the number of the multiple pairs of sheet conveying rollers 61 through 65 to be arranged in an axial direction of each roller is not limited. Specifically, the number and installation location of the multiple pairs of sheet conveying rollers 61 through 65 are determined according to a design of the document conveying path 56, a length in the document feeding direction of a smallest size of the original document sheet S that is allowable to the ADF 5, and so forth.

The pair of sheet conveying rollers 61 is disposed adjacent to the downstream side of the sheet feeding belt 59 and functions as a pull out roller. That is, when the leading edge of the original document sheet S conveyed to the pair of sheet conveying rollers 61 according to the driving timing of the pickup roller 58 contacts against the pair of sheet conveying rollers 61, the pair of sheet conveying rollers 61 corrects skew of the original document sheet S. Simultaneously, the pair of sheet conveying rollers 61 pulls out and conveys the corrected original document sheet S in the document feeding direction.

The pair of sheet conveying rollers 61 conveys the original document sheet S to the pair of sheet conveying rollers 62 disposed downstream from the pair of sheet conveying rollers 61. The pair of sheet conveying rollers 61 is driven by reverse rotation of the sheet feed motor 102. When the sheet feed motor 102 rotates reversely, the pickup roller 58 and the sheet feeding belt 59 are not driven while the pair of sheet conveying rollers 61 and 62 are driven.

Further, the pair of sheet conveying rollers 62 functions as a pair of turning roller such that the original document sheet S that is conveyed from the pair of sheet conveying rollers 61 is forwarded to a turning portion 56*a* of the document conveying path 56.

A conveying speed of the original document sheet S that is conveyed from the registration part C to the turning part D due to rotations of the pairs of sheet conveying rollers 61 and 62 is set higher than the conveying speed of the original document sheet S in the first scanning and conveying part E. Specifically, it is promoted to reduce the process time to convey the original document sheet S to the first scanning and conveying part E.

The pair of sheet conveying rollers 63 is disposed downstream from the turning portion 56*a* of the document conveying path 56 in the document feeding direction. The pair of sheet conveying rollers 63 functions as a pair of scan entrance rollers to sequentially convey the original document sheet S after passing the turning portion 56*a* to the first exposure glass 45. The original document sheet S that has passed the first exposure glass 45 is conveyed to the second surface scanning device 48 by the pair of sheet conveying rollers 64 that functions as a first pair of scan exit rollers. The original document sheet S is further conveyed to the document outlet slot 55*b* by the pair of sheet conveying rollers 65 that functions as a second pair of scan exit rollers.

The document conveying unit 52 further includes a first scanning roller 66 and a document discharging roller 67.

The first scanning roller 66 is disposed at an upward position of the first exposure glass 45.

The document discharging roller 67 is disposed in the vicinity of the document outlet slot 55*b* to discharge the original document sheet S from the document outlet slot 55*b* toward the original document discharging tray 53.

The first scanning roller 66 is biased by a biasing member such as a coil spring toward the first exposure glass 45. When the original document sheet S is conveyed, the first scanning roller 66 causes the original document sheet S to be conveyed on or over the first exposure glass 45 to closely contact and simultaneously move to the downstream side in the document feeding direction.

The document conveying unit 52 includes the second surface scanning device 48 that is disposed in a relatively linear conveyance area that is located downstream from the first scanning roller 66 and between the pair of sheet conveying rollers 64 and the pair of sheet conveying rollers 65.

The second surface scanning device 48 includes a back surface scanning unit 69, a shading roller 70, and a conveyance gap adjuster.

The back surface scanning unit 69 reads an image formed on the back surface of the original document sheet S.

The shading roller 70 is disposed facing the back surface scanning unit 69 with the document conveying path 56 interposed therebetween.

The back surface scanning unit 69 includes a contact image sensor (CIS), for example. The back surface scanning unit 69 reads an image formed on the back surface (a second surface) of the original document sheet S after the image forming unit 44 of the original document scanner 4 has read an image formed on a front surface (a first surface) of the original document sheet S.

The shading roller 70 holds down an upward curl of the original document sheet S in the back surface scanning unit 69. At the same time, the shading roller 70 functions as a white color reference member to acquire shading data in the back surface scanning unit 69. It is to be noted that, when the back surface of the original document sheet S is not read, the original document sheet S passes through the back surface scanning unit 69 without stopping.

The conveyance gap adjuster is additionally mounted on a bearing that supports the shading roller 70, for example, to adjust a gap formed between the back surface scanning unit 69 and the shading roller 70. With the conveyance gap adjuster, the back surface scanning unit 69 is set to an optimum depth of focus, so that the image reading quality of the recording medium is not impaired.

The original document table 51 further includes a first document length detection sensor 81A and a second document length detection sensor 81B disposed spaced apart in the document feeding direction. The first document length detection sensor 81A and the second document length detection sensor 81B detect whether the original document sheet S is loaded on the original document table 51 in a portrait orientation or in a landscape orientation.

In addition to the first document length detection sensor 81A and the second document length detection sensor 81B, a guide distance detection sensor, for example, can be provided to detect an opposed distance of the pair of side guide plates 54. By using the guide distance detection sensor together with the first document length detection sensor 81A and the second document length detection sensor 81B, the size of the original document sheet S placed on the original document table 51 can be detected.

A document set sensor 82 is disposed in the vicinity of the bottom plate of the downstream side of the original document table 51. The document set sensor 82 detects the position of the lowest part on the moving track of a leading end of the set feeler 57 so as to check whether or not the original document sheet S is placed on the original document table 51.

A bottom plate home position sensor 83 is disposed at a lower part of the downstream side of the movable original document table 51A. The bottom plate home position sensor 83 detects that the movable original document table 51A has turned downwardly and reached a home position thereof.

The document conveying unit 52 includes and arranges a table lift sensor 84, a document contact sensor 85, a document width sensor 86, a scan entrance sensor 87, a registration sensor 88, and a document discharging sensor 89 in this order from an upstream side to a downstream side of the document feeding direction of the original document sheet S.

The table lift sensor 84 detects a position of a top surface of the bundle of original document sheets S loaded on the movable original document table 51A.

The document contact sensor 85 is disposed between the sheet feeding belt 59 and the sheet conveying roller 61 to detect the leading edge and the trailing edge of the original document sheet S.

The document width sensor 86 is disposed between the sheet conveying roller 61 and the sheet conveying roller 62. The document width sensor 86 includes multiple light emitting elements and multiple light receiving elements. The multiple light emitting elements are aligned along the width direction of the original document sheet S. The light receiving elements are aligned facing the respective multiple light emitting elements with the document conveying path 56 thereof.

The scan entrance sensor 87, the registration sensor 88, and the document discharging sensor 89 are used to control distance and speed of conveyance of the original document sheet S and to detect a jammed sheet or jammed sheets.

Figure 6:
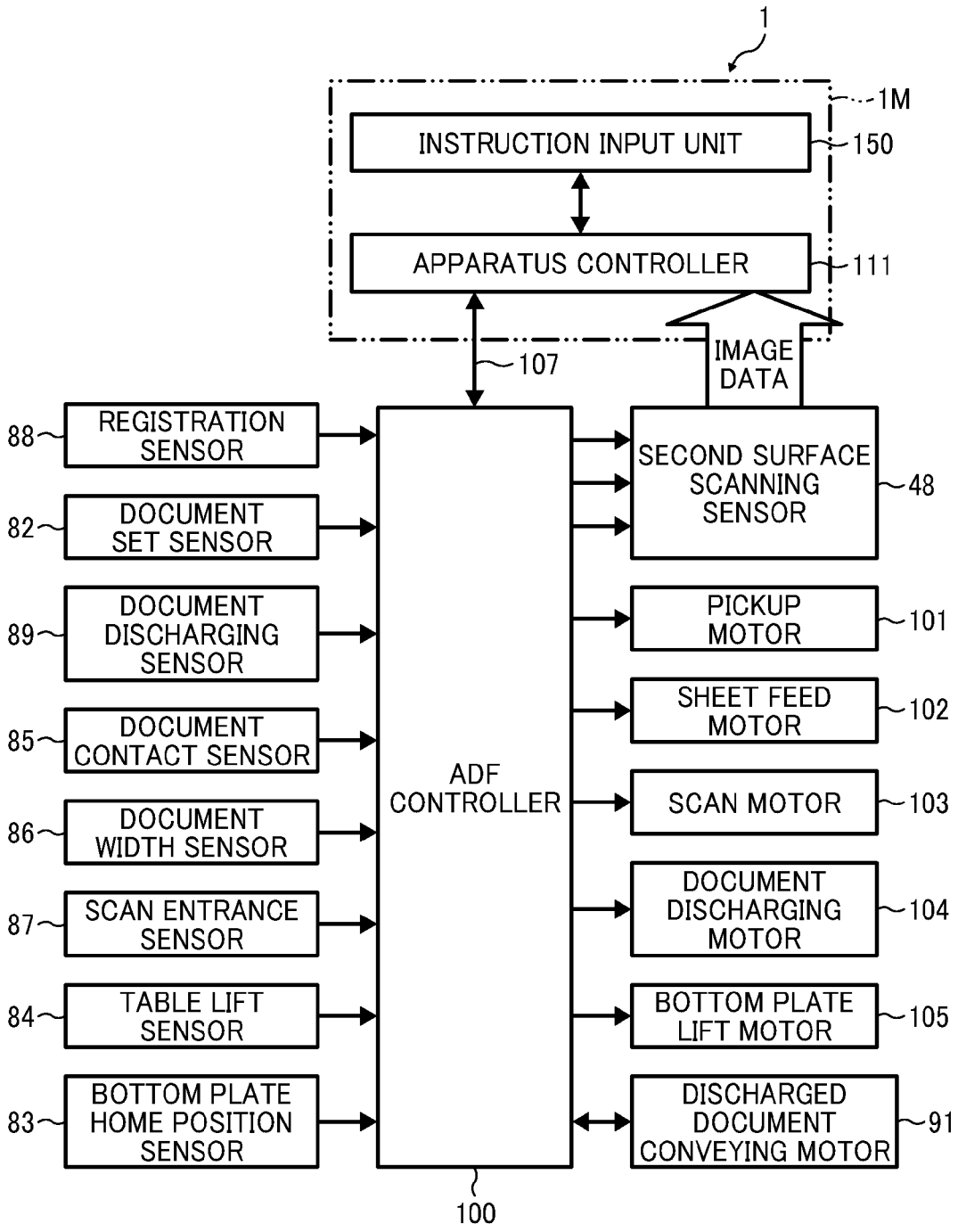
FIG. 6 is a block diagram illustrating a configuration of a control part of the image forming apparatus and the image forming apparatus of FIG. 1.

As illustrated in FIG. 6, the image forming apparatus 1 further includes the ADF controller 100, an apparatus controller 111, and the instruction input unit 150.

As previously described, the ADF controller 100 controls operations performed by the ADF 5.

The apparatus controller 111 controls operations performed by the devices provided in the apparatus body 1M.

The instruction input unit 150 is mounted on the upper front side of the image forming apparatus 1 and functions as a control unit to receive instructions to be transmitted to the apparatus controller 111.

The ADF controller 100 is connected to the document set sensor 82, the bottom plate home position sensor 83, the table lift sensor 84, the document contact sensor 85, the document width sensor 86, the scan entrance sensor 87, the registration sensor 88, and the document discharging sensor 89, as illustrated in FIG. 6. The ADF controller 100 receives various detection signals from these sensors.

The ADF controller 100 is also connected to the pickup motor 101, the sheet feed motor 102, and a scan motor 103. Under control of the ADF controller 100, the pickup motor 101 drives the pickup roller 58, the sheet feed motor 102 drives the sheet feeding belt 59 and the pairs of sheet conveying rollers 61 and 62, and the scan motor 103 drives the pairs of sheet conveying rollers 63 through 65. Further, the ADF controller 100 is also connected to a document discharging motor 104 to drive the document discharging roller 67 and the bottom plate lift motor 105 to lift the movable original document table 51A. Furthermore, the ADF controller 100 is connected to a discharged document conveying motor 91 to rotate a first roller unit 92 of the sheet discharging device 90.

The ADF controller 100 issues a timing signal to the second surface scanning device 48 to notify a timing that the leading edge of the original document sheet S reaches an image scanning position of the back surface scanning unit 69. Thereafter, the image data is processed as valid image data.

The ADF controller 100 and the apparatus controller 111 are connected via an interface (I/F) 107. As the print key 151 of the instruction input unit 150 is pressed down, a document feeding signal to feed the original document sheet S or a reading start signal to start reading the image data of the original document sheet S is issued and sent to the ADF controller 100 via the I/F 107.

Figure 7:
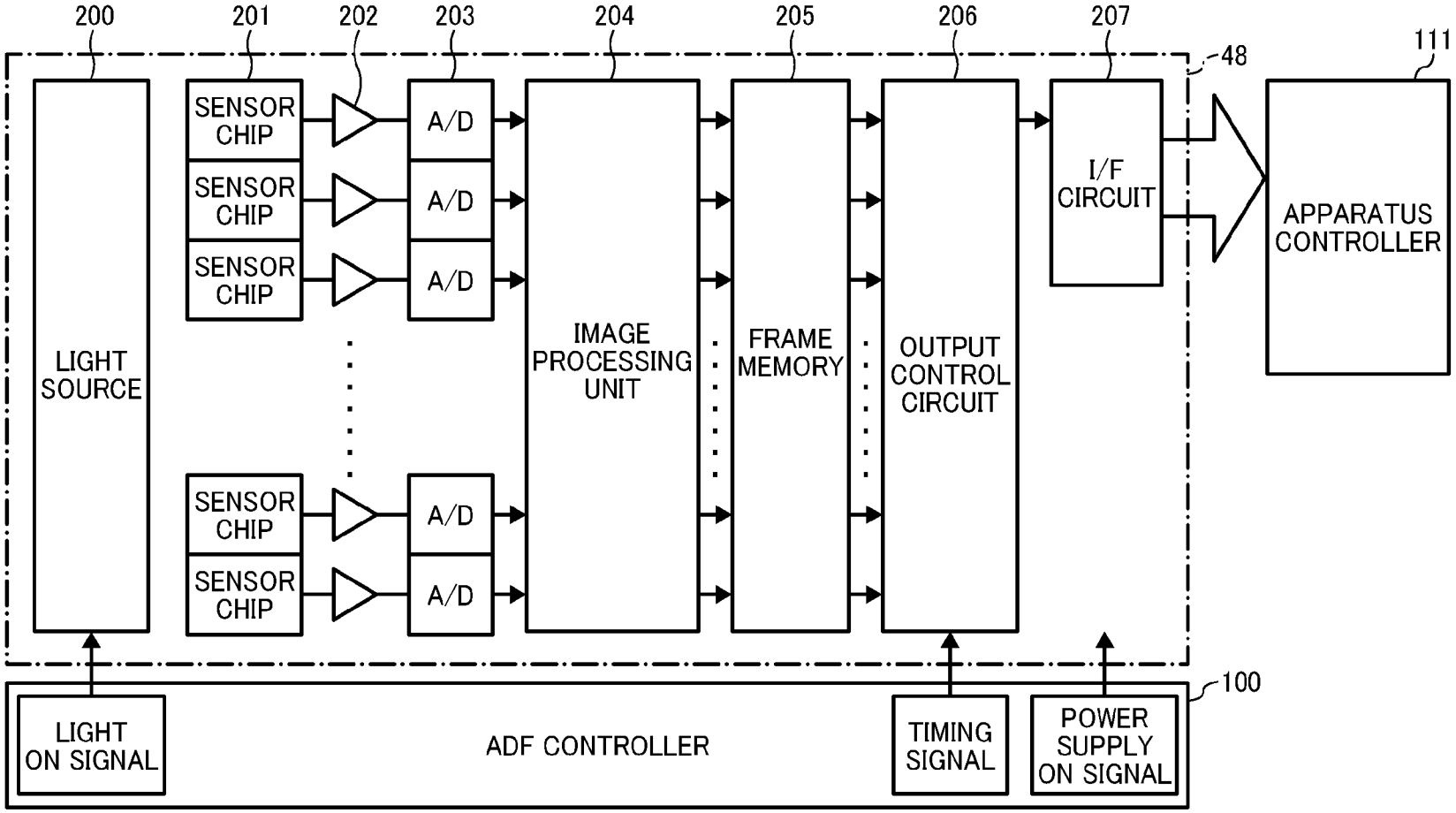
FIG. 7 is a block diagram illustrating a second face reading part of the image forming apparatus of FIG. 1.

FIG. 7 is a block diagram illustrating the second surface scanning device 48 of the image forming apparatus 1.

As illustrated in FIG. 7, the second surface scanning device 48 includes a light source 200, multiple sensor chips 201, multiple operational (OP) amplifier circuits 202, multiple analog-to-digital (A/D) converters 203, an image processing unit 204, a frame memory 205, an output control circuit 206, and an interface (I/F) circuit 207.

The light source 200 can be a light emitting diode (LED) array, a fluorescent lamp, or a cold cathode tube. The light source 200 emits light to the original document sheet S based on a light ON signal transmitted from the ADF controller 100. Further, the second surface scanning device 48 receives the timing signal to notify a timing at which the leading edge of the original document sheet S reaches the image scanning position of the back surface scanning unit 69 and a power supply on signal of the light source 200 from the ADF controller 100.

The multiple sensor chips 201 are arranged along the main scanning direction of the original document sheet S, which is a width direction of the original document sheet S.

The multiple OP amplifier circuits 202 are individually connected to the corresponding multiple sensor chips 201.

The multiple A/D converters 203 are individually connected to the corresponding multiple OP amplifier circuits 202.

Each of the multiple sensor chips 201 includes a photoelectric converting element that is called as an equal magnification contact image sensor and a condenser lens. The light reflected on the second surface of the original document sheet S is collected by the condenser lens of each sensor chip 201 to the photoelectric converting element and is read as image data by the multiple sensor chips 201.

The image data read by the respective sensor chips 201 is amplified by the multiple OP amplifier circuits 202, and then is converted to digital image data by the respective A/D converters 203.

The digital image data is inputted to the image processing unit 204, adjusted by shading, and temporarily stored in the frame memory 205. After the output control circuit 206 has converted the digital data into a data format that can be received by the apparatus controller 111, the digital data is output to the apparatus controller 111 via the I/F circuit 207.

When the original document sheet S is loaded on the movable original document table 51A, the ADF controller 100 transmits the detected information to the apparatus controller 111. In addition, the ADF controller 100 causes the bottom plate lift motor 105 to rotate to move the movable original document table 51A upward until the top surface of the bundle of original document sheets S contacts the pickup roller 58.

On receipt of the document feeding signal, the ADF controller 100 causes the pickup motor 101 to drive the pickup roller 58, so that the pickup roller 58 picks up the uppermost original document sheet S placed on top of the movable original document table 51A.

When the document set sensor 82 detects the lowest position of the moving track of the leading end of the set feeler 57, the ADF controller 100 determines that the original document sheet S is not loaded on the movable original document table 51A.

By contrast, the document set sensor 82 does not detect the lowest position of the moving track of the leading end of the set feeler 57, the ADF controller 100 determines that the original document sheet S is loaded on the movable original document table 51A.

The ADF controller 100 determines based on the information detected by the bottom plate home position sensor 83 that the movable original document table 51A has reached the home position.

When the original document sheets S are fed repeatedly and the top surface of the bundle of original document sheets S detected by the table lift sensor 84 reaches below an appropriate level, the ADF controller 100 causes the bottom plate lift motor 105 to drive to move the movable original document table 51A upward. Further, when the movable original document table 51A is lifted and the top surface of the bundle of original document sheets S detected by the table lift sensor 84 reaches above the appropriate level, the ADF controller 100 causes the bottom plate lift motor 105 to stop. By so doing, the top surface of the bundle of original document sheets S is maintained at the appropriate level for feeding the original document sheets S.

After the original document sheets S on the movable original document table 51A have been completely fed and the movable original document table 51A becomes empty, the ADF controller 100 causes the bottom plate lift motor 105 to drive to lower the movable original document table 51A to the home position. By so doing, the movable original document table 51A becomes ready to receive another bundle of original document sheets S for a subsequent document feeding operation.

Based on the detection timing of the leading edge and the trailing edge of the original document sheet S obtained by the document contact sensor 85, the ADF controller 100 determines a length of the original document sheet S in the document conveying direction according to the pulse of the sheet feed motor 102 corresponding to the distance of conveyance of the original document sheet S.

The ADF controller 100 causes the sheet feed motor 102 to drive until the leading edge of the single original document sheet S due to the sheet feeding belt 59 and the reverse roller 60 contacts the sheet conveying roller 61 that functions as a pull out roller. That is, the ADF controller 100 causes the sheet feed motor 102 to stop in a state in which the leading edge of the original document sheet S is pressed to the sheet conveying roller 61 and the original document sheet S remains curved by a given amount. By so doing, the leading edge of the original document sheet S enters into a nip region of the sheet conveying roller 61, and the leading edge of the original document sheet S is aligned (skew correction).

After the original document sheet S is conveyed by the sheet conveying roller 61, the ADF controller 100 determines the size of the original document sheet S in the width direction, which is a direction perpendicular to the document feeding direction of the original document sheet S, based on the detection results of the light receiving element of the document width sensor 86.

After the scan entrance sensor 87 has detected the leading edge of the original document sheet S, the ADF controller 100 reduces the speed of conveyance of the original document sheet S to be equal to the speed of scanning of the original document sheet S while conveying the original document sheet S before the leading edge of the original document sheet S enters the nip region formed by the sheet conveying roller 63 in the vicinity of the scan entrance sensor 87.

Further, the ADF controller 100 causes the scan motor 103 to drive the pairs of sheet conveying rollers 63 through 65.

When the registration sensor 88 detects the leading edge of the original document sheet S, the ADF controller 100 decelerates the speed of conveyance of the original document sheet S within a given conveyance distance of the original document sheet S, and stops the original document sheet S temporarily at a registration position that is located before an image scanning position R of the first exposure glass 45. Then, the ADF controller 100 transmits a registration stop signal to indicate that the original document sheet S is temporarily stopped at the registration position to the apparatus controller 111.

Consequently, when a scan start signal is transmitted from the apparatus controller 111, the ADF controller 100 causes the original document sheet S that has been temporarily stopped at the registration position is conveyed with the speed of conveyance of the original document sheet S accelerated to gain a given speed of conveyance of the original document sheet S before the leading edge of the original document sheet S reaches the image scanning position R of the first exposure glass 45.

When the leading edge of the original document sheet S detected according to the pulse count of the scan motor 103 reaches the image scanning position R of the first exposure glass 45, the ADF controller 100 transmits a gate signal that indicates a valid image region in the sub-scanning direction of the first surface of the original document sheet S to the apparatus controller 111. The ADF controller 100 continues transmission of the gate signal to the apparatus controller 111 until the trailing edge of the original document sheet S passes through the image scanning position R.

For a single-sided reading mode in which a single side (the front surface or the first surface) of the original document sheet S is scanned, when the document discharging sensor 89 detects the leading edge of the original document sheet S, the ADF controller 100 causes the document discharging motor 104 to drive to rotate the document discharging roller 67 in a document discharging direction. Further, the ADF controller 100 decelerates the speed of conveyance of the original document sheet S at a timing immediately before the trailing edge of the original document sheet S passes by from the nip region formed by the document discharging roller 67, according to the number of pulses of the document discharging motor 104 counted by the document discharging sensor 89 starting from detection of the leading edge of the original document sheet S.

When the timing comes, the speed of conveyance of the original document sheet S is decelerated, so that the original document sheet S to be discharged to the original document discharging tray 53 cannot be placed projected from the original document discharging tray 53.

For duplex reading in which the front surface and the back surface of the original document sheet S are scanned, the ADF controller 100 measures the counted number of pulses of the scan motor 103 after the document discharging sensor 89 has detected the leading edge of the original document sheet S. At this time, the ADF controller 100 detects a document arrival timing when the leading edge of the original document sheet S reaches the image scanning position of the back surface scanning unit 69 of the second surface scanning device 48 according to the counted number of pulses of the scan motor 103.

Prior to entrance of the original document sheet S to the image scanning position of the back surface scanning unit 69 of the second surface scanning device 48, the ADF controller 100 outputs the light ON signal to the light source 200 to light the light source 200. On receipt of the light ON signal, the light source 200 is turned on to emit light toward the second surface (the back surface) of the original document sheet S.

Then, the ADF controller 100 transmits the gate signal that indicates the valid image region in the sub-scanning direction of the back surface, i.e., the second surface of the original document sheet S to the second surface scanning device 48 from the above-described document arrival timing to a timing when the trailing edge of the original document sheet S passes by the image scanning position of the back surface scanning unit 69. Further, the ADF controller 100 scans the white color reference member of the shading roller 70 to acquire shading data of the second surface scanning device 48.

Next, a description is given of details of the sheet discharging device 90 of the image forming apparatus 1, in reference to FIGS. 8 through 11.

Figure 8:
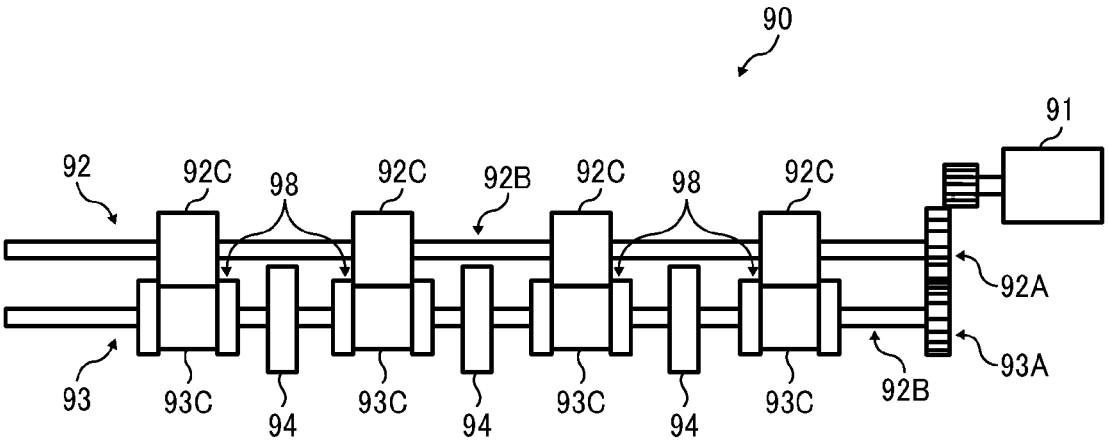
FIG. 8 is a diagram illustrating a sheet discharging device of the image forming apparatus of FIG. 1.

As illustrated in FIG. 8, the sheet discharging device 90 includes a discharged document conveying motor 91, a first roller unit 92, and a second roller unit 93.

The discharged document conveying motor 91 functions as a driving source.

The discharged document conveying motor 91 exerts a driving force to be transmitted to the first roller unit 92 to rotate.

The first roller unit 92 functions as a first rotary unit to include a driving gear 92A, a driving shaft 92B, and multiple driving rollers 92C.

The driving gear 92A rotates due to the driving force exerted by the discharged document conveying motor 91.

The driving shaft 92B is rotated together with the driving gear 92A.

The multiple driving rollers 92C are fixedly mounted on the driving shaft 92B. The multiple driving rollers 92C rotate integrally with the driving shaft 92B.

The multiple driving rollers 92C include an elastic body made of rubber, for example. However, the material of each of the multiple driving rollers 92C is not limited thereto.

The second roller unit 93 functions as a second rotary unit to include a driven gear 93A, a driven shaft 93B, multiple driven rollers 93C, and multiple stiffening rollers 94.

The driven gear 93A meshes with the driving gear 92A.

The driven shaft 93B is driven and coupled with the first roller unit 92 via the driven gear 93A and is linked to the driven gear 93A to rotate together.

The multiple driven rollers 93C are mounted spaced apart on the driven shaft 93B. The multiple driven rollers 93C are disposed rotatable about the driven shaft 93B and facing in press-contact with the multiple driving rollers 92C.

A pressed portion of each of the multiple driving rollers 92C and a corresponding one of the multiple driven rollers 93C forms a discharged sheet nip region 98.

The multiple driven rollers 93C include a resin material, for example. However, the material of each of the multiple driven rollers 93C is not limited thereto. Regardless of material types, the multiple driving rollers 92C is softer than the multiple driven rollers 93C. In other words, a hardness of each of the multiple driving rollers 92C is smaller than a hardness of each of the multiple driven rollers 93C.

It is to be noted that a gear ratio of the driving gear 92A and the driven gear 93A is adjusted such that a peripheral speed of each of the multiple driving rollers 92C is equal to a peripheral speed of each of the multiple stiffening rollers 94.

The multiple stiffening rollers 94 are disposed between two adjacent driven rollers of the multiple driven rollers 93C on the driven shaft 93B. Each of the multiple driven rollers 93C and each of the multiple stiffening rollers 94 are arranged alternatively. The multiple stiffening rollers 94 are fixedly mounted on the driven shaft 93B to rotate integrally with the driven shaft 93B.

A diameter of each of the multiple stiffening rollers 94 is greater than an outer diameter of each of the multiple driven rollers 93C. The multiple stiffening rollers 94 are projected upwardly from the discharged sheet nip regions 98 formed between the multiple driving rollers 92C and the multiple driven rollers 93C. The multiple stiffening rollers 94 stiffen the recording medium.

Figure 9:
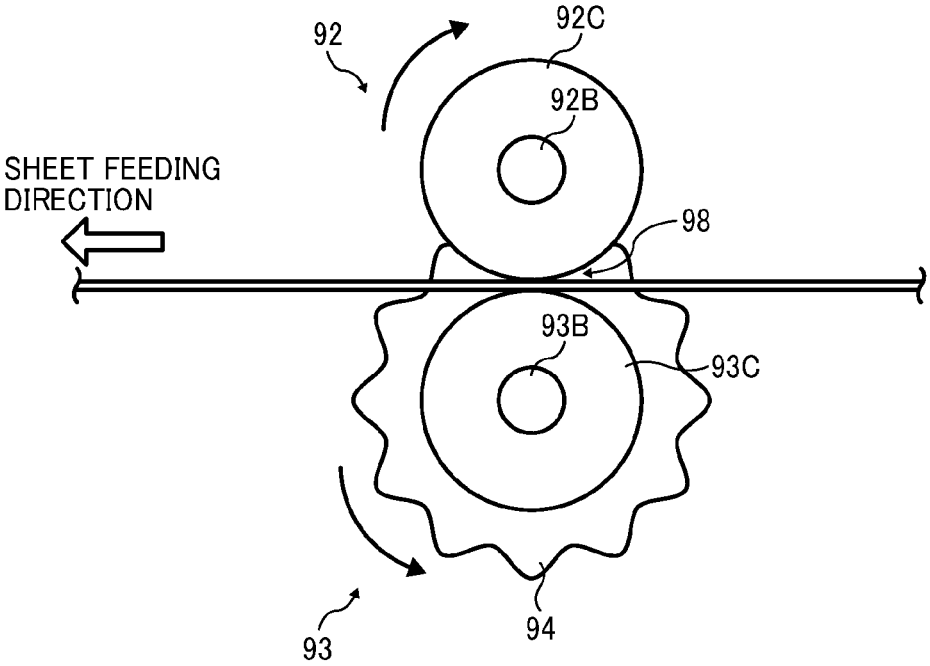
FIG. 9 is a diagram illustrating the sheet discharging device of the image forming apparatus of FIG. 1, viewed in an axial direction thereof.

As illustrated in FIG. 9, an outer appearance of the multiple stiffening rollers 94 is not a simple circle but has a projection or projections. According to this configuration, the multiple stiffening rollers 94 can kick out the trailing edge of the recording medium after conveyance, which enhances the stackability of the recording medium P or the recording media P.

It is to be noted that the present example of this disclosure is given with the first roller unit 92 and the second roller unit 93, which are units in which various rollers are employed. However, a configuration that can be applied to this disclosure is not limited thereto. For example, a rotary unit that employs a belt-type member can be applied to this disclosure to achieve the same effect as the above-described example.

Similarly, the present example of this disclosure is given with the multiple driving rollers 92C, the multiple driven rollers 93C, and the multiple stiffening rollers 94. However, a configuration that can be applied to this disclosure is not limited thereto but any other rotary body such as a belt can be applied to this disclosure.

It is also to be noted that each of the multiple stiffening rollers 94 is disposed facing a position at which no roller (no rotary body) is mounted on the driving shaft 92B.

Figure 10A:
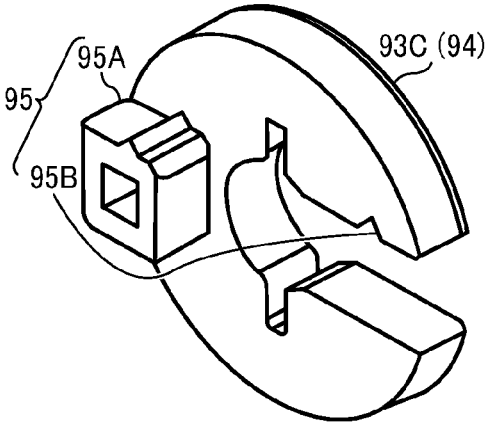
FIG. 10A is a diagram illustrating a divided part of a driven roller and a stiffening roller included in the image forming apparatus of FIG. 1.
Figure 10B:
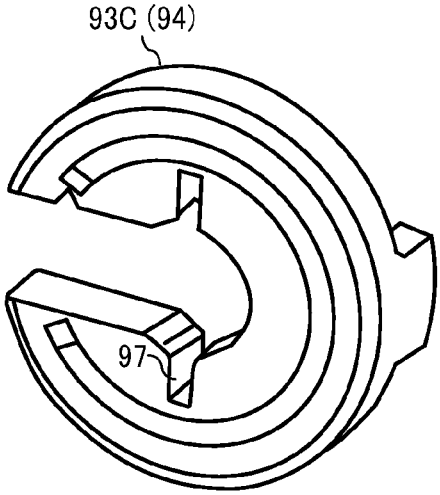
FIG. 10B is a diagram illustrating another divided part of the driven roller and the stiffening roller included in the image forming apparatus of FIG. 1.

As illustrated in FIGS. 10A and 10B, the multiple driven rollers 93C or the multiple stiffening rollers 94 can be divided. That is, each of the multiple driven rollers 93C and each of the multiple stiffening rollers 94 can be separated into two parts having an identical shape. Each of the two separated parts includes a snap fastener 95 that includes a projection 95A and a recess 95B. By attaching the projection 95A of the snap fastener 95 formed on one part and the recess 95B of the snap fastener 95 formed on the other part as an integrated unit and holding the driven shaft 93B between the two parts, each of the multiple driven rollers 93C is shaped as a roller that is rotatable about the driven shaft 93B.

Figure 11:
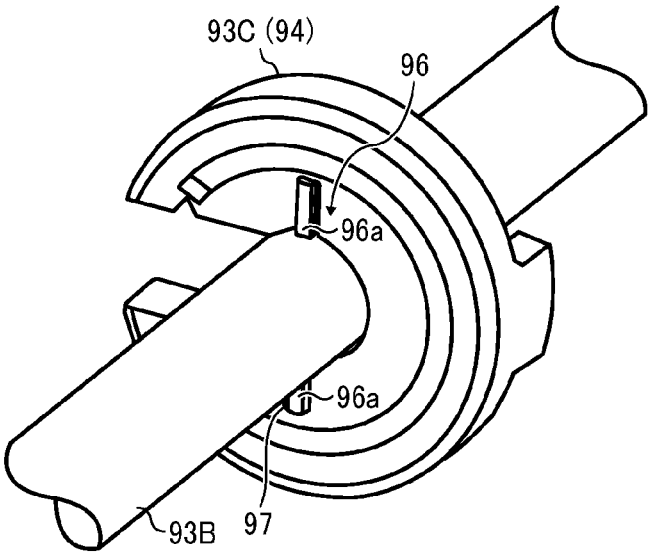
FIG. 11 is a diagram illustrating the image forming apparatus of FIG. 1 in a state in which the stiffening roller is fixed to a driven shaft with a spring pin.

When using this configuration for the multiple stiffening rollers 94, the multiple stiffening rollers 94 are fixed to the driven shaft 93B, as illustrated in FIG. 11. Specifically, in the configuration according to the present example, a spring pin 96 that includes two projections 96*a* is attached to the driven shaft 93B to engage with a spring pin hole 97 in a state in which the two projections 96*a* of the spring pin 96 project in two different directions from the driven shaft 93B along the spring pin hole 97. By so doing, the multiple driven rollers 93C can be fixedly mounted on the driven shaft 93B.

It is to be noted that the present example of this disclosure is given with the configuration having a single spring pin 96 with two projections 96*a*. However, the number of spring pins is not limited thereto and can be two or more. Similarly, the number of projections is not limited thereto and can be one, three or more.

As described above, the image forming apparatus 1 according to an example of this disclosure includes the sheet discharging device 90 provided with the multiple stiffening rollers 94. The sheet discharging device 90 has the configuration in which the driving gear 92A meshes with the driven gear 93A and the gear ratio of the driving gear 92A and the driven gear 93A is adjusted such that the peripheral speed of each of the multiple driving rollers 92C is equal to the peripheral speed of each of the multiple stiffening rollers 94. According to this configuration, the recording medium is stiffened, and therefore there is no difference between the peripheral speed of the multiple driving rollers 92C and the peripheral speed of the multiple driving rollers 92C and the multiple stiffening rollers 94. Consequently, gloss streaks occurring on the recording medium can be prevented. As a result, removal of curl of the recording medium by stiffening the recording medium P and sheet stackability of the recording medium P or the recording media P are enhanced and, at the same time, image defect is prevented.

Further, the multiple driven rollers 93C disposed facing the multiple driving rollers 92C are rotatably mounted on the driven shaft 93B. According to this configuration, the multiple driven rollers 93C are rotated along with rotation of the multiple driving rollers 92C. Therefore, there is no linear velocity difference between the multiple driven rollers 93C and the multiple driving rollers 92C in the respective discharged sheet nip regions 98.

Further, the multiple stiffening rollers 94 are integrally fixed to the driven shaft 93B. According to this configuration, even after the recording medium has passed through the discharged sheet nip region 98, the multiple stiffening rollers 94 keep rotating. Therefore, as compared to a configuration in which the multiple stiffening rollers 94 are rotatably attached to the driven shaft 93B, this configuration in which the multiple stiffening rollers 94 are fixed to the driven shaft 93B is more effective to kick off the recording medium from the sheet discharging device 90 of the image forming apparatus 1.

Further, each of the multiple stiffening rollers 94 includes at least one projection and at least one recess on an outer circumferential surface thereof. That is, there are projections and recesses on the outer circumferential surface of each of the multiple stiffening rollers 94. According to this configuration, the sheet discharging device 90 can kick off the trailing edge of the recording medium to be discharged outside the apparatus body 1M of the image forming apparatus 1. Consequently, the sheet stackability of the recording medium P or the recording media P can be enhanced.

Further, each of the multiple stiffening rollers 94 includes an elastic body. With this configuration, the tolerance to gloss streaks can be enhanced.

Further, the multiple driven rollers 93C and the multiple stiffening rollers 94 may be an integrated unit constituted by multiple parts. With this configuration, assembly performance of the second roller unit 93.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A recording medium conveyor comprising:

a driving source configured to generate a driving force;

a first rotary unit rotated by the driving force, the first rotary unit including a driving gear configured to rotate by receiving the driving force, a driving shaft configured to rotate together with the driving gear, and multiple driving rotary bodies spaced apart from each other on the driving shaft, the multiple driving rotary bodies fixed to and configured to rotate together with the driving shaft;

a second rotary unit facing the first rotary unit and configured to be rotated by the first rotary unit, the second rotary unit including:

a driven gear meshed with the driving gear, a driven shaft to rotate together with the driven gear, multiple driven rotary bodies rotatably supported by the driven shaft, disposed spaced apart from each other on the driven shaft, and pressed against the multiple driving rotary bodies, and multiple stiffening rotary bodies spaced apart from each other on the driven shaft, between adjacent two of the multiple driven rotary bodies, and having a diameter greater than an outer diameter of each of the multiple driven rotary bodies, the multiple stiffening rotary bodies fixed to and configured to rotate together with the driven shaft, a gear ratio between the driving gear of the first rotary unit and the driven gear of the second rotary unit being adjusted such that a peripheral speed of each of the multiple driving rotary bodies is equal to a peripheral speed of each of the multiple stiffening rotary bodies.

2. The recording medium conveyor according to claim 1, wherein each of the multiple driving rotary bodies is a driving roller, wherein each of the multiple driven rotary bodies is a driven roller, and wherein each of the multiple stiffening rotary bodies is a stiffening roller.

3. The recording medium conveyor according to claim 1, wherein each of the multiple stiffening rotary bodies includes a projection and a recess on an outer circumferential surface thereof.

4. The recording medium conveyor according to claim 1, wherein each of the multiple stiffening rotary bodies includes an elastic body.

5. The recording medium conveyor according to claim 1, wherein each of the multiple driven rotary bodies is integrally connected via the driven shaft.

6. The recording medium conveyor according to claim 1, wherein each of the multiple stiffening rotary bodies is integrally connected via the driven shaft.

7. The recording medium conveyor according to claim 1, wherein each of the multiple stiffening rotary bodies faces a position at which no rotary body is mounted on the driving shaft.

8. The recording medium conveyor according to claim 1, wherein each of the multiple driving rotary bodies includes an elastic material and each of the multiple driven rotary bodies includes a resin material, and wherein a hardness of each of the multiple driving rotary bodies is smaller than a hardness of each of the multiple driven rotary bodies.

9. An image forming apparatus comprising:

an image forming device to form an image on a recording medium; and the recording medium conveyor according to claim 1 to convey the recording medium.

10. The recording medium conveyor according to claim 1, wherein the multiple stiffening rollers are configured to project upwardly from a sheet nip region formed between the multiple driving rotary bodies and the multiple driven rotary bodies.

11. The recording medium conveyor according to claim 1, wherein each of the multiple driven rotary bodies and each of the multiple stiffening rotary bodies can be separated into two parts having an identical shape.

12. The recording medium conveyor according to claim 11, wherein each of the two separated parts includes a snap fastener.

13. The recording medium conveyor according to claim 12, wherein the snap fastener includes a projection and a rcccss.

14. The recording medium conveyor according to claim 13, wherein, by attaching the projection of the snap fastener formed on one part and the recess of the snap fastener formed on the other part as an integrated unit and holding the driven shaft between the two parts, each of the multiple driven rotary bodies is shaped as a roller dial is rotatable about the driven shaft.

15. The recording medium conveyor according to claim 11, further comprising a spring pin that includes two projections is attached to the driven shaft to engage with a spring pin hole in a state in which the two projections of the spring pin 96 project in two different directions from the driven shaft along the spring pin hole.

16. A recording medium conveyor comprising:

a driving source configured to generate a driving force;

a first rotary unit rotated by the driving force, the first rotary unit including:

a driving gear configured to rotate by receiving the driving force, a driving shaft configured to rotate together with the driving gear, and multiple driving rotary bodies spaced apart from each other on the driving shaft, the multiple driving rotary bodies to integrally rotate with the driving shaft;

a second rotary unit facing the first rotary unit and configured to be rotated by the first rotary unit, the second rotary unit including:

a driven gear meshed with the driving gear, a driven shaft to rotate together with the driven gear, multiple driven rotary bodies rotatably supported by the driven shaft, disposed spaced apart from each other on the driven shaft, and pressed against the multiple driving rotary bodies, and multiple stiffening rotary bodies spaced apart from each other on the driven shaft, between adjacent two of the multiple driven rotary bodies, and having a diameter greater than an outer diameter of each of the multiple driven rotary bodies, the multiple stiffening rotary bodies to integrally rotate with the driven shaft, and each of the multiple stiffening rotary bodies includes a projection and a recess on an outer circumferential surface thereof; and a gear ratio between the driving gear of the first rotary unit and the driven gear of the second rotary unit being adjusted such that a peripheral speed of each of the multiple driving rotary bodies is equal to a peripheral speed of each of the multiple stiffening rotary bodies.

17. A recording medium conveyor comprising:

a driving source configured to generate a driving force;

a first rotary unit rotated by the driving force, the first rotary unit including:

a driving gear configured to rotate by receiving the driving force, a driving shaft configured to rotate together with the driving gear, and multiple driving rotary bodies spaced apart from each other on the driving shaft, the multiple driving rotary bodies to integrally rotate with the driving shaft;

a second rotary unit facing the first rotary unit and configured to be rotated by the first rotary unit, the second rotary unit including:

a driven gear meshed with the driving gear, a driven shaft to rotate together with the driven gear, multiple driven rotary bodies rotatably supported by the driven shaft, disposed spaced apart from each other on the driven shaft, and pressed against the multiple driving rotary bodies, and multiple stiffening rotary bodies spaced apart from each other on the driven shaft, between adjacent two of the multiple driven rotary bodies, and having a diameter greater than an outer diameter of each of the multiple driven rotary bodies, the multiple stiffening rotary bodies to integrally rotate with the driven shaft, and each of the multiple stiffening rotary bodies faces a position at which no rotary body is mounted on the driving shaft; and a gear ratio between the driving gear of the first rotary unit and the driven gear of the second rotary unit being adjusted such that a peripheral speed of each of the multiple driving rotary bodies is equal to a peripheral speed of each of the multiple stiffening rotary bodies.

* * * * *